US010053851B2

(12) United States Patent
Toms et al.

(10) Patent No.: US 10,053,851 B2
(45) Date of Patent: Aug. 21, 2018

(54) ADJUSTABLE DRAIN

(71) Applicant: Impey Showers Limited, Bridgenorth (GB)

(72) Inventors: Matthew Jason Toms, Chard (GB); Nicholas Melville, Chard (GB)

(73) Assignee: IMPEY SHOWERS LIMITED, Bridgenorth (GB)

( * ) Notice: Subject to any disclaimer, the term of this patent is extended or adjusted under 35 U.S.C. 154(b) by 191 days.

(21) Appl. No.: 14/794,547

(22) Filed: Jul. 8, 2015

(65) Prior Publication Data

US 2016/0032578 A1 Feb. 4, 2016

Related U.S. Application Data

(63) Continuation-in-part of application No. PCT/EP2013/077975, filed on Dec. 24, 2013.

(30) Foreign Application Priority Data

Jan. 8, 2013 (GB) ..... 1300284.5

(51) Int. Cl.
*A47K 3/00* (2006.01)
*E03F 5/04* (2006.01)

(52) U.S. Cl.
CPC ..... *E03F 5/0408* (2013.01); *E03F 5/04* (2013.01); *E03F 5/0407* (2013.01); *E03F 2005/0413* (2013.01)

(58) Field of Classification Search
CPC ..... E03F 5/0407; E03F 5/0408
USPC ..... 4/679, 288; 210/164, 165
See application file for complete search history.

(56) References Cited

U.S. PATENT DOCUMENTS

| | | | | |
|---|---|---|---|---|
| 638,692 A | | 12/1899 | Banwell | |
| 1,792,345 A | * | 2/1931 | Williams | E03F 5/0407 137/362 |
| 2,519,843 A | * | 8/1950 | Matheis | E03F 5/0407 210/165 |
| 4,067,072 A | * | 1/1978 | Izzi | E03F 5/0407 285/12 |
| 7,735,512 B1 | | 6/2010 | Ismert et al. | |

(Continued)

FOREIGN PATENT DOCUMENTS

| | | |
|---|---|---|
| GB | 2 421 517 A | 6/2006 |
| GB | 2 444 492 A | 6/2008 |
| WO | WO 2008/009874 A1 | 1/2008 |

OTHER PUBLICATIONS

UK Intellectual Property Office Combined Search & Examination Report on GB1300284.5—dated May 15, 2013.

(Continued)

*Primary Examiner* — Christine Skubinna
(74) *Attorney, Agent, or Firm* — Steven R. Vosen

(57) ABSTRACT

A height-adjustable assembly for a drain, comprises a lower portion for use with a waste outlet of the drain, an upper portion to receive an attachment for mounting at floor level to cover the assembly, and an adjustment portion disposed between the upper and lower portions and including first and second adjustment elements disposed respectively on inner and outer faces of the adjustment portion to simultaneously vary the position of the upper and adjustment portions relative to the lower portion as the adjustment portion is rotated.

17 Claims, 3 Drawing Sheets

(56) References Cited

U.S. PATENT DOCUMENTS

2010/0235982 A1* 9/2010 Stimpson ..... E03F 5/0408
4/679

OTHER PUBLICATIONS

International Search Report and Written Opinion on PCT/EP2013/077975—dated Apr. 2, 2014.

* cited by examiner

ADJUSTABLE DRAIN

CROSS-REFERENCE TO RELATED APPLICATIONS

This application is a continuation-in-part of PCT application PCT/EP2013/077975, filed 24 Dec. 2013, which claims the benefit of GB application number 1300284.5, filed 8 Jan. 2013. These applications are incorporated herein by reference in their entireties.

BACKGROUND OF THE INVENTION

Field of the Invention

The present invention generally relates to floor drains, and more particularly to methods and apparatus for providing an adjustable-height floor drain.

Discussion of the Background

Wet rooms have become increasingly popular, for example as access for the disabled has developed into an important consideration in building construction, and with the provision of readily available component parts to enable construction of such rooms in the home relatively easily.

Typically, a wet room includes a water resistant floor covering that incorporates a suitable fall to a waste water drain such that water on the room floor, such as from a shower, will drain away. The floor covering can be tiling beneath which a waterproof layer on a deck can be provided. The deck typically includes a preformed gradient to define the fall to the waste water drain.

Normally, a waste is selected which allows a flush finish to be achieved between the uppermost portion of the waste and the surrounding floor. When a flexible waterproof floor covering material is to be used, a waste must be specifically selected which permits engagement of the floor covering material with the waste. Furthermore, it is desirable for the upper portion of a drain waste to be level with the top of the flooring being used in order to successfully allow waste water to be conveyed into the drain, to provide a suitable visual quality to the finish, and to be comfortable and safe to walk on or to pass a wheelchair over for example when using the shower. These aspects typically result in multiple parallel ranges of wastes being offered to suit different situations.

According to an example, there is provided a height-adjustable assembly for a drain, comprising a lower portion for use with a waste outlet of the drain, an upper portion to receive an attachment for mounting at floor level to cover the assembly, and an adjustment portion disposed between the upper and lower portions and including first and second adjustment elements disposed respectively on inner and outer faces of the adjustment portion to simultaneously vary the position of the upper and adjustment portions relative to the lower portion as the adjustment portion is rotated. The lower and upper portions can include respective locking elements to cooperate to rotationally constrain the upper portion as its position relative to the lower portion is varied. In an example, the locking element of the upper portion can include a flange, lip or channel. The locking element of the lower portion can include a protrusion. The respective locking elements can be arranged to slideably engage with one another.

The lower portion can be fixed, and can include a clamping element to secure a covering or membrane material. The covering or membrane can be a flexible waterproof material to deliver a waterproof course. In an example, the first adjustment element can include a helical thread or ramp to cooperate with a ramp follower disposed on an outer face of the upper portion. The second adjustment element can cooperate with a helical ramp or thread disposed on an inner face of the lower portion. The second adjustment element can be a protuberance on the outer face of the adjustment portion. The ramp follower disposed on the outer face of the upper portion can be a helical thread or ramp. The ramp follower disposed on the outer face of the upper portion can be a protuberance. The upper, lower and adjustment portions can be circular and fit concentrically within each other.

In an example, the height-adjustable assembly can further include a rotation control element to control a position of the adjustment portion to one of multiple discrete positions. The rotation control element can include multiple indentations on a face of a helical ramp or thread disposed on an inner face of the lower portion. The adjustment portion can include a projection to releasably engage with an indentation of the lower portion thereby to bias the adjustment portion in position.

According to an example, there is provided a floor drain for a shower, including a height-adjustable assembly as claimed in any preceding claim connected to a waste outlet for the drain. The upper portion can include an attachment mounted at floor level to receive waste water.

According to an example, there is provided a method for the telescopic height-adjustment of a drain, including providing an adjustment portion disposed between an upper and lower portion of a drain assembly, the adjustment portion including first and second adjustment elements disposed respectively on inner and outer faces of the adjustment portion, and rotating the adjustment portion to vary the position of the upper and adjustment portions relative to the lower portion. The upper portion has one degree of freedom.

Use of the term waste water drain or waste herein throughout means a waste water unit for connection to a drain, into which waste water runoff enters, and to which flexible waterproof floor covering material can be connected or engaged.

Embodiments will now be described, by way of example only, with reference to the accompanying drawings, in which:

Reference symbols are used in the Figures to indicate certain components, aspects or features shown therein, with reference symbols common to more than one Figure indicating like components, aspects or features shown therein.

DETAILED DESCRIPTION OF THE INVENTION

Figure 1:
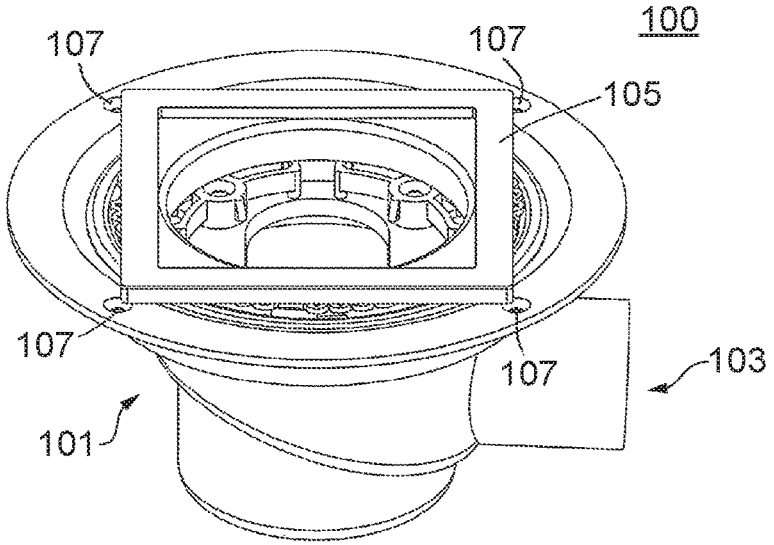
FIG. 1 is a perspective view of a floor drain according to an example.

FIG. 1 is a perspective view of a floor drain body, referred to herein as body 100, according to an example. A body 101 includes a waste exit 103 through which waste water exits the body 100 and a floor drain bowl 409. A top attachment plate 105 is shown, which can receive a grate or similar, through which waste water from a shower floor can be received. According to an example, the height of the drain once in situ can is adjusted as will be described below so that the attachment plate 105 is arranged flush with the level of the floor in or to which the body 100 is fitted. Typically, the edges of the top attachment plate 105 meet tiles or other suitable flooring for a shower or wet room to provide a substantially continuous or uninterrupted surface.

Body 100 can include floor drain bowl 409 having fixing means 107 to receive a screw or other suitable fixing device to secure the body in place. Body 100 can also be connected to a trap to prevent foul air and water returning to a shower room. As is typical, the waste exit 103 can be connected to pipe work to convey waste water away.

Figure 2:
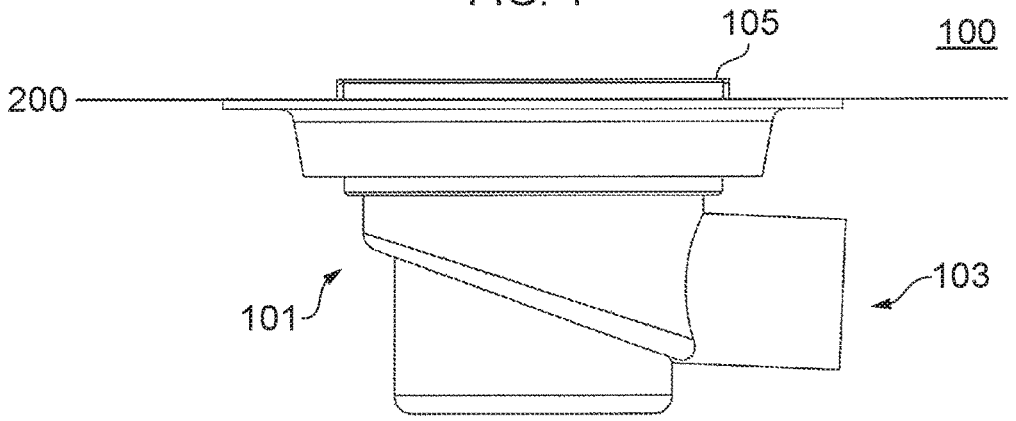
FIG. 2 is a side view of a floor drain in a first position according to an example.

FIG. 2 is a side view of a floor drain in a first position according to an example. Body 100 and waste exit 103 are visible. Line 200 depicts the level at which the body 100 is secured to the underlying flooring of a shower or wet room. For example, line 200 can be the level above which waterproofing, such as waterproof membranes, and tiling can be provided. As shown in FIG. 2, top attachment plate 105 is shown protruding above the line 200 so that a membrane and/or tiling and so on can be accommodated whilst preserving a flush effect. It should be noted that in such a position, the top attachment plate 105 may be provided so that its upper edge is flush with line 200. That is, such that the plate 105 sits within the body 100.

Figure 3:
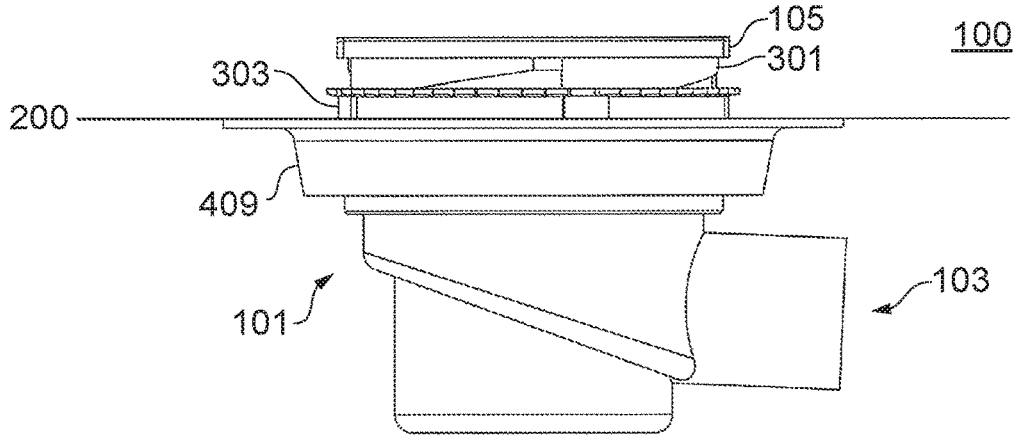
FIG. 3 is a side view of a floor drain in a height-adjusted position according to an example.

FIG. 3 is a side view of a floor drain in a height-adjusted position according to an example. In the example of FIG. 3, the height of top attachment plate 105 is in a fully deployed position. That is, the drain has been adjusted so that the top attachment plate 105 is at its maximum height above the line 200. In FIG. 3, an upper portion 301 and an adjustment portion 303 of the drain are visible. In the fully deployed position as shown, the upper and adjustment portions are fully extended.

Figure 4:
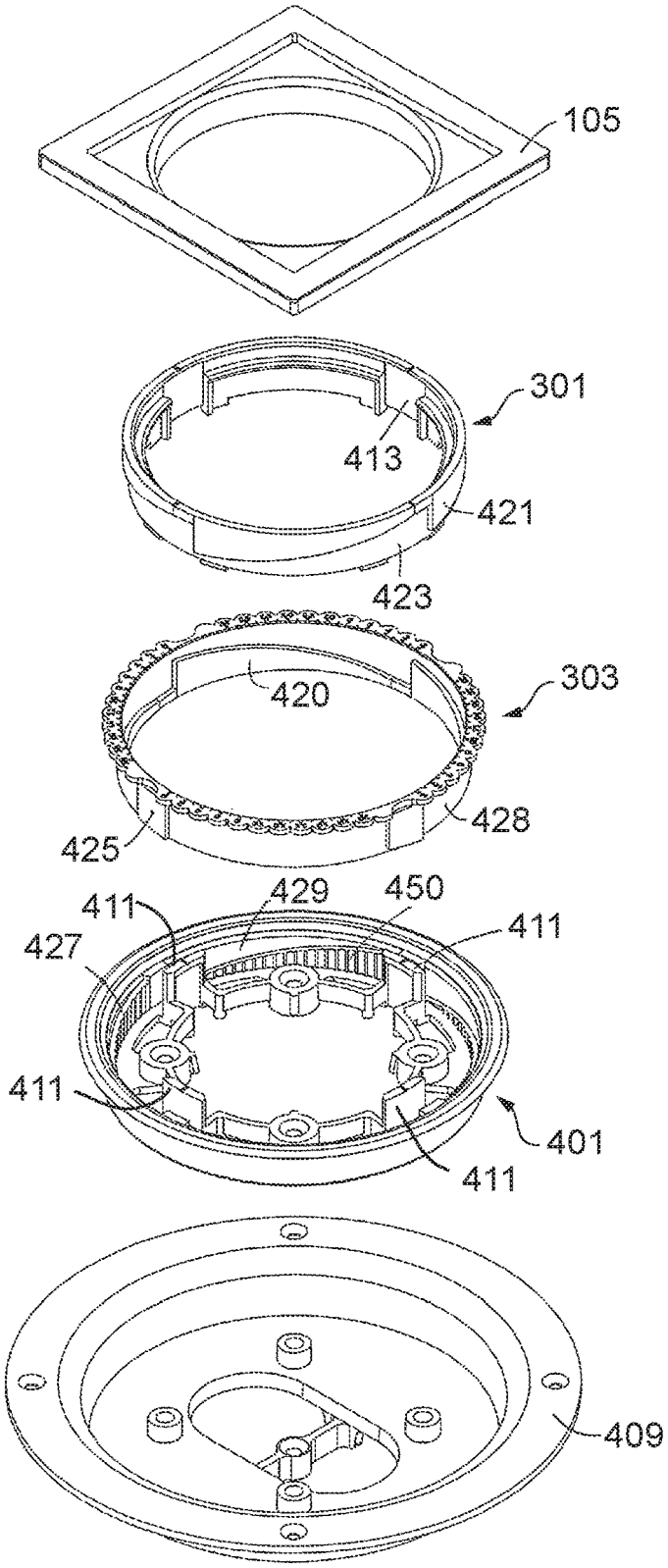
FIG. 4 is an exploded perspective schematic diagram of a floor drain according to an example.

FIG. 4 is an exploded perspective schematic diagram of a floor drain according to an example. A height adjustable assembly is shown in exploded form, and includes a lower portion 401, upper portion 301 and adjustment portion 303. Top attachment plate 105 and floor drain bowl 409 are also shown. In an example, floor drain bowl 409 attaches to or otherwise engages with the drain body as described above.

According to an example, lower portion 401 fits within and is secured to the bowl 409. The lower portion is thus in fluid communication with the waste outlet or exit of the drain, and waste water can pass into the waste outlet via the lower portion. The upper portion 301 can receive the top attachment plate 105, which can be mounted at floor level to cover the drain and receive a grate for example.

According to an example, adjustment portion 303 is disposed between the upper 301 and lower 401 portions and includes first and second adjustment elements disposed respectively on inner and outer faces thereof. The adjustment elements are used to simultaneously vary the position of the upper 301 and adjustment 303 portions relative to the lower portion 401 as the adjustment portion 303 is rotated. According to an example, the lower portion 401 remains stationary in the drain bowl 409 since it is fixed thereto, the bowl 409 being itself fixed into position with respect to the flooring into which a floor drain is installed or otherwise provided.

Adjustment portion 303 is rotated in order to vary the position of the upper and adjustment portions relative to the lower portion 401. More specifically, as the adjustment portion 303 is rotated the adjustment elements operate to effect a simultaneous change in the height of the adjustment and upper portions relative to the lower portion. For example, the adjustment elements operate against each other to effect a simultaneous change in the height of the adjustment and upper portions relative to the lower portion as the adjustment portion 303 is rotated. According to an example, the upper portion 301 has one degree of freedom. More specifically, the height of the upper portion 301 can be adjusted but it is rotationally constrained and cannot therefore turn as its vertical position varies. This is particularly advantageous since a top attachment plate fixed to the upper portion 301 can have its height relative to floor level adjusted whilst maintaining a desired orientation of the plate.

According to an example, lower portion 401 and upper portion 301 include respective elements that cooperate to rotationally constrain the upper portion as its position relative to the lower portion is varied. With reference to FIG. 4, a protrusion 411 or similar of the lower portion 401 extends inwards from an inner face 429 of the lower portion 401 with sufficient radial to accept both adjustment portion 303 and upper portion 301 between each protrusion 411 and inner face 429. Protrusion 411 is thus able to be received within a channel 413 or similar of the upper portion 301 when the portions of the assembly are fitted together. The combination of the protrusion 411 and channel 413 is such to allow the upper portion to move vertically with respect to the lower portion, whilst preventing any rotational movement of the upper portion by virtue of abutment of the protrusion 411 within or on the channel 413. Multiple such protrusions and channels can be provided. For example, FIG. 4 shows four protrusions 411 on portion 401 that can engage with corresponding channels 413 of portion 301. The elements are arranged to slideably engage with one another so that movement of the portions relative to one another is not hindered. For example, the edges of the elements that are arranged to come into contact with another can be smooth and continuous.

It will be appreciated the locking elements need not be limited to those described. For example, one or more protrusions may be present on the upper portion, with corresponding channels on the lower portion. One or more channels can be substituted for any element that acts against a protrusion to prevent rotational movement of the upper portion, such as a lip or flange for example. In an example, rotational movement of the upper portion is constrained as the portion is adjusted in height both up and down. However, the constraint can be effective in only one direction if desired, with a corresponding removal or modification of the locking elements accordingly.

According to an example, the lower portion 401 can include a clamping element to secure a covering or membrane material. The clamping element can comprise multiple resilient portions (not shown) underneath which a membrane or covering can be arranged. As the assembly and drain is fixed into place, the resilient portions can be arranged to clamp down onto the membrane in order to hold it firmly in place and create a watertight seal for the drain. Typically therefore, the covering or membrane is a flexible waterproof material to deliver a waterproof course for the shower or wet room.

According to an example, the first adjustment element of the adjustment portion 303 includes a helical thread or ramp 420 to cooperate with a ramp follower 421 disposed on an outer face 423 of the upper portion 301. The second adjustment element 425 of the adjustment portion 303 cooperates with a helical ramp or thread 427 disposed on inner face 429 of the lower portion 401. In an example, the second adjustment element 425 is a protuberance on the outer face 428 of the adjustment portion 303, such as a column for example. Multiple adjustment elements can be provided, although a single set can suffice. As shown in FIG. 4, multiple columns and multiple ramps/threads are shown. In an example, four protuberances are provided, and four ramps/threads are provided. A corresponding number of ramp followers and so on can be provided on other portions of the assembly as required to match the number provided on the adjustment portion. Alternatively, fewer matching elements can be provided.

In an example, a ramp follower disposed on the outer face of the upper portion can be a helical thread or ramp, whereas a ramp follower disposed on the outer face of the adjustment portion can be a protuberance for example. As will be apparent from the figures, the upper, lower and adjustment portions are circular and fit concentrically within each other. As such, and in a non-deployed position, the upper portion protrudes from the body by only a small amount, and can be arranged to lie flush with the top of the body if desired. However, and as mentioned above, the provision of membranes and tiling for example means that it is desirable to have the upper portion sit above the level of the body by some degree since it will typically always be the case that there will be some flooring materials present.

According to an example, a rotation control element to control a position of the adjustment portion to one of multiple discrete positions is provided. With reference to FIG. 4, the lower portion 401 includes multiple indentations depicted generally by 450 on a face of a helical ramp or thread disposed on an inner face thereof. A projection is provided on the adjustment portion 303 to releasably engage with an indentation of the lower portion thereby to bias the adjustment portion in position. For example, the vertical face of the or each ramp of the lower portion 401 can include multiple concave notches to engage with a corresponding convex notch on the adjustment portion 303. Accordingly, rotation can be controlled to a defined number of discrete positions.

Figure 5:
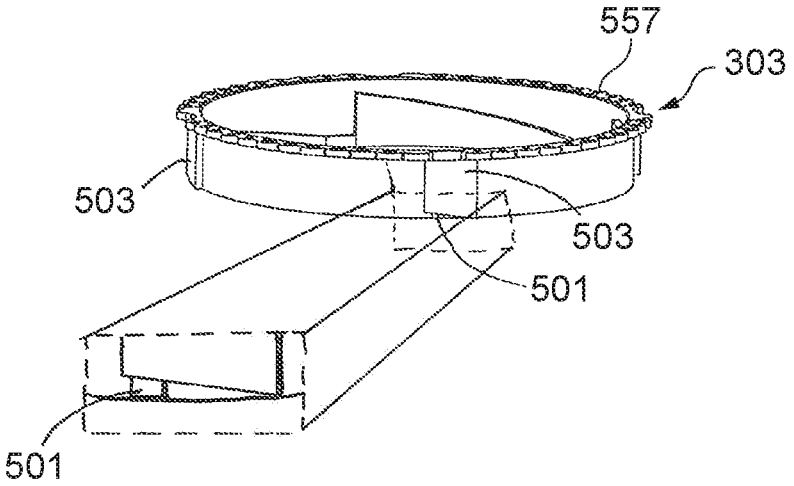
FIG. 5 is a side perspective view of an adjustment portion according to an example.
Figure 6:
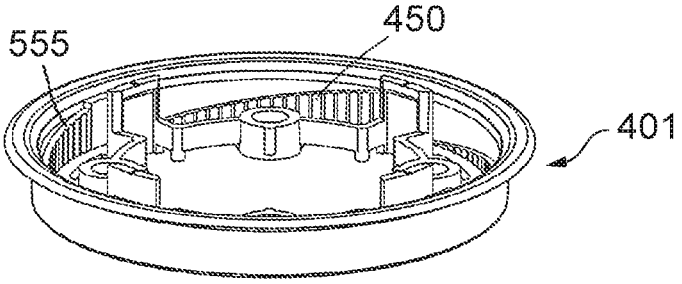
FIG. 6 is a side perspective view of a lower portion according to an example.

FIG. 5 is a side perspective view of an adjustment portion according to an example. A convex notch 501 is shown disposed beneath a protuberance of the adjustment portion 303 in the form of a column 503. Column 503 has a lower sloped profile to match the slope of a ramp or thread of the lower portion with which it engages in use, as shown in FIG. 6, which is side perspective view of a lower portion according to an example. In an example, notch 501 is provided in a region underneath column 503, such as at the region where the sloped lower portion of the column 503 exposes the outer face of the adjustment portion 303. In this way, the multiple indentations can be provided on the outer or vertical face of the ramp or thread on the inner face of the lower portion. An enlarged view of the lower portion of the column 503 showing the profile and the notch 501 is shown in FIG. 5.

In an example, indentations 450 need not be concave, but can be any suitable profile. Alternatively, the indentations 450 can actually be protuberances to engage into an indentation that replaces the notch 501. Alternatively indentations or protuberances can be provided on the upper face 555 of the ramp or thread of the lower portion 401. As such, a notch or indentation can be provided on the lower sloped portion of the column 503 to engage therewith.

According to an example, adjustment portion 303 can be provided with scalloped outer portions 557 that can be used to help grip and rotate the portion. A scallop can be provided with a visual indicator to assist a user in determining an adjustment level. For example, scalloped portions can include numerical values to depict the height above the lower portion that the adjustment and/or upper portion of the assembly are arranged at. The lower portion can include a suitable marker to indicate the numerical value to be noted as the correct height, and multiple such markers can be provided to indicate the current height of the adjustment portion and the upper portion for example.

According to an example, the projection/notch 501 can releasably engage with the indentations of the lower portions thereby to bias the adjustment portion in position. This allows the rotation of the assembly to be controlled with defined positive 'clickstops' as the notch snaps in and out of place in the indentations. In an example, each click raises (or lowers) the upper portion by 1 mm. Advantageously, the cooperation of the notch/indentation prevents the assembly from slipping down unintentionally.

According to an example, a method for the telescopic height-adjustment of a drain includes providing an adjustment portion disposed between an upper and lower portion of a drain assembly as described above and rotating the adjustment portion to vary the position of the upper and adjustment portions of the assembly relative to the lower portion. More specifically, a drain body is installed into place into a shower or wet room. An assembly as described herein can be fitted into the body once it is in place, or beforehand. A waterproof membrane can be laid, and held in place between an upper lip of the body and the lower portion of the assembly as mentioned above. A top plate can be attached to the upper portion of the assembly before or after the height of the assembly is adjusted. The adjustment portion is rotated until a desired height for the assembly is attained. The assembly is maintained in place by virtue of the rotation control element of the assembly.

The invention claimed is:

1. A height-adjustable assembly for a drain, comprising:

a lower portion for use with a waste outlet of the drain, where the lower portion has an inner face and a protrusion extending parallel to and inside of the inner face;

an adjustment portion having an outer face and an inner face, where said outer face is proximate to the inner face of the lower portion, and where the adjustment portion is disposed between the inner face of the lower portion and the protrusion;

an upper portion to receive an attachment for mounting at floor level to cover the assembly, where said upper portion has an inner face including a channel that accepts the protrusion, said upper portion having an outer face proximate to the inner face of the adjustment portion, and where the upper portion is disposed between the inner face of the lower portion and the protrusion; and adjustment elements on the inner face of the lower portion, both faces of the adjustment portion, and the outer face of the upper portion, where, when the adjustment portion is rotated, the adjustment elements cooperate to simultaneously adjust a height of the upper and adjustment portions relative to the lower portion, and the protrusion and channel cooperate to rotationally constrain the upper portion as its position relative to the lower portion is adjusted.

2. A height-adjustable assembly as claimed in claim 1, wherein the locking element of the upper portion includes a flange, lip or channel.

3. A height-adjustable assembly as claimed in claim 1, wherein the locking element of the lower portion includes a protrusion.

4. A height-adjustable assembly as claimed in claim 1, wherein the respective locking elements are arranged to slideably engage with one another.

5. A height-adjustable assembly as claimed in claim 1, wherein the first adjustment element includes a helical thread or ramp to cooperate with a ramp follower disposed on an outer face of the upper portion.

6. A height-adjustable assembly as claimed in claim 1, wherein the second adjustment element cooperates with a helical ramp or thread disposed on an inner face of the lower portion.

7. A height-adjustable assembly as claimed in claim 1, wherein the second adjustment element is a protuberance on the outer face of the adjustment portion.

8. A height-adjustable assembly as claimed in claim 5, wherein the ramp follower disposed on the outer face of the upper portion is a helical thread or ramp.

9. A height-adjustable assembly as claimed in claim 5, wherein the ramp follower disposed on the outer face of the upper portion is a protuberance.

10. A height-adjustable assembly as claimed in claim 1, wherein the upper, lower and adjustment portions are circular and fit concentrically within each other.

11. A height-adjustable assembly as claimed in claim 1, further including a rotation control element to control a position of the adjustment portion to one of multiple discrete positions.

12. A height-adjustable assembly as claimed in claim 11, wherein the rotation control element includes multiple indentations on a face of a helical ramp or thread disposed on an inner face of the lower portion.

13. A height-adjustable assembly as claimed in claim 12, wherein the adjustment portion includes a projection to releasably engage with an indentation of the lower portion thereby to bias the adjustment portion in position.

14. A floor drain for a shower, including:

a height-adjustable assembly as claimed in claim 1 connected to a waste outlet for the drain.

15. A floor drain for a shower as claimed in claim 14, wherein the upper portion includes an attachment mounted at floor level to receive waste water.

16. A method for the telescopic height-adjustment of a drain, including:

providing an upper and a lower portion of a drain assembly, where the upper portion and the lower portion include cooperating elements that rotationally constrains the upper portion relative to the lower portion;

providing an adjustment portion disposed between an upper and lower portion of a drain assembly, the adjustment portion including first and second adjustment elements disposed respectively on inner and outer faces of the adjustment portion; and rotating the adjustment portion to simultaneously vary a height of the upper and adjustment portions relative to the lower portion and rotationally constrain the upper portion relative to the lower portion.

17. A method as claimed in claim 16, wherein the upper portion has one degree of freedom.

* * * * *